US005469775A

United States Patent [19]

Stoll et al.

[11] Patent Number: 5,469,775

[45] Date of Patent: Nov. 28, 1995

[54] LINEAR DRIVE WITH A BUFFER DEVICE

[75] Inventors: Kurt Stoll, Esslingen; Dieter Waldmann, Ebersbach; Thomas Feyrer, Esslingen, all of Germany

[73] Assignee: Festo KG, Esslinger, Germany

[21] Appl. No.: 240,645

[22] PCT Filed: Aug. 13, 1992

[86] PCT No.: PCT/EP92/01848

§ 371 Date: May 13, 1994

§ 102(e) Date: May 13, 1994

[87] PCT Pub. No.: WO93/10360

PCT Pub. Date: May 27, 1993

[30] Foreign Application Priority Data

Nov. 16, 1991 [DE] Germany ..... 41 37 789.3

[51] Int. Cl.[6] ..... F01B 29/00

[52] U.S. Cl. ..... 92/88; 92/165 R; 277/DIG. 7

[58] Field of Search ..... 92/88, 146, 165 R; 277/DIG. 7

[56] References Cited

U.S. PATENT DOCUMENTS 4,856,415 8/1989 Noda ..... 92/88

FOREIGN PATENT DOCUMENTS 0140138 5/1985 European Pat. Off. .
0294350 12/1988 European Pat. Off. .
0475032 3/1992 European Pat. Off. .
3925219 2/1991 Germany .
3190909 10/1988 Japan ..... 92/88
1295009 11/1989 Japan ..... 92/88

*Primary Examiner*—Thomas E. Denion
*Attorney, Agent, or Firm*—Hoffmann & Baron

[57] ABSTRACT

A linear-drive device with a housing (1) in which a drive element (3) is fitted in such a way that longitudinal motion is permitted. On the outside of the housing (1) is a longitudinal guide element (16) on which a guide rail (18) is mounted, also in such a way that longitudinal motion is permitted. A lug (14) projecting through a longitudinal slot (13) in the housing (1) connects the drive element (3) with the guide rail (18). In order to prevent the lug (14) being damaged if the drive element (3) strikes one of the end stops, a buffer device (30) acting in the direction of motion is located in the connection between the guide rail (18) and the drive element (3).

17 Claims, 3 Drawing Sheets

LINEAR DRIVE WITH A BUFFER DEVICE

SPECIFICATION

Figure 1:
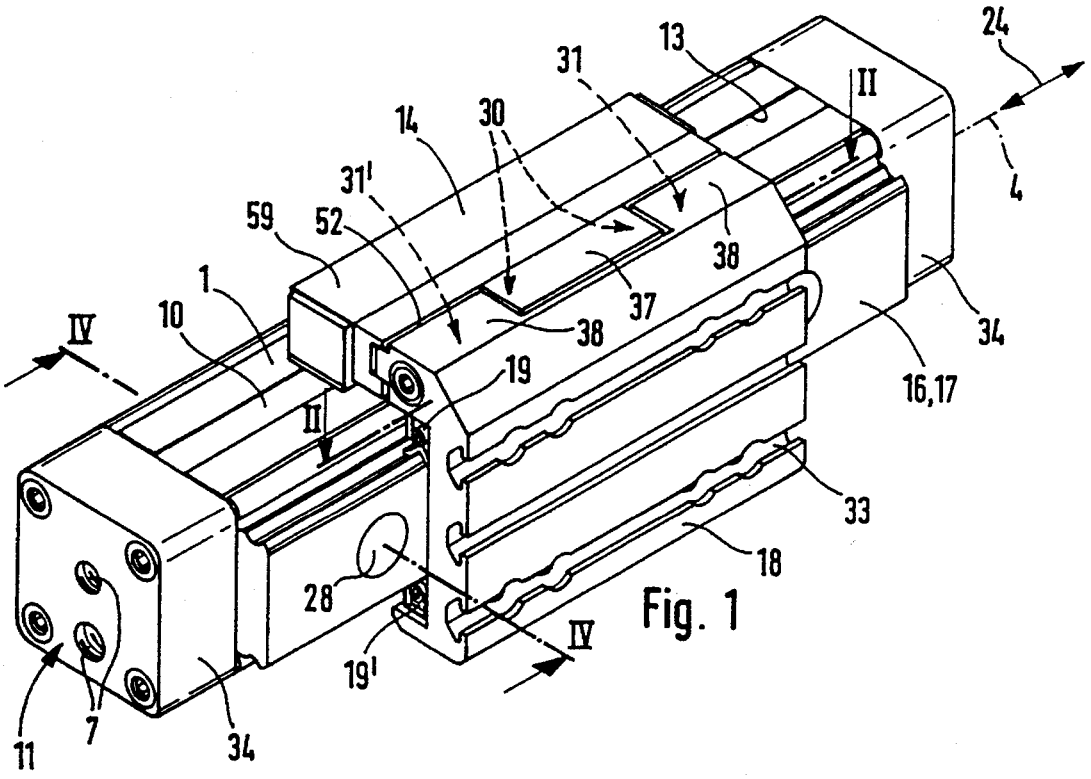

The invention relates to a linear drive having a housing with a longitudinal slot, with a drive part which is mounted longitudinally moveable in the housing, with a longitudinal guide being mounted outside of the housing on which a guide element is mounted longitudinally moveable and on which a load to be moved can be mounted and a lug which extends through the longitudinal slot and connecting the drive element with the guide element by forming a moving unit therewith, and a buffer element cooperating in the movement direction of the movement unit and the guide element.

A linear drive of this type is described in the EP-A-0 140 138. It is formed as a so-called slot cylinder, whereby the drive is actuated by means of a pressure medium. The carriage like guide element is guided by a longitudinal guide formed by the cylinder housing and is synchronously moved when displacing the drive element by a coupling with the lug. The guide element forms a power transmission member on which any given loads may be mounted which have to be moved. In light of the external guiding unfavorable loads on the drive element are substantially prevented. The guide element is flanked on both sides by one each runner and connected therewith by means of shock absorbers. Each runner has a brake means which can be selectively actuated for positioning the movement unit, whereby the shock absorber cause a progressive delay of the movement unit.

In such a device the runners with the associated shock absorbers practically form adjustable stroke limiting abutments for the guide element, whereby the effect is principally comparable with the device described in DE-A-39 25 219. However, if the guide element is coupled with a relative heavy load, further high inertia forces occur when the drive element reaches the end positions which stress the lug and may result in the breaking of the same. A given reenforcement of the lug is not possible, since its possible dimensions are limited by the width of the longitudinal slot.

In the case of EP-A-0 294 350 no buffer means is provided. However, due to the particular design of a coupling between the drive element and the guide element it permits certain lateral movements. However, the axial connection is quasi rigid, so that tension and pressure forces are fully transmitted.

It is therefore an object of the invention to provide a linear drive of the aforementioned type wherein the stresses of the lug during the braking action are reduced without expensive adjustments of stroke limiting abutments.

For solving this object it is provided that the buffer element is disposed in the connection between the drive element and the guide element which connects immediately with the lug.

In this manner the guide element and the drive element are decoupled to a certain extent in the movement direction, i.e., in the longitudinal direction of the housing. Beginning with a certain load the buffer element permits an axial relative movement between the guide element and the drive element, whereby the immediate stresses, in particular on the lug are reduced to a degree which exclude any damages. It does not require any external stroke limiting abutments, so that the user of the linear drive does not have to take any adjustment or adjusting operations pertaining to a given use situation. Hence, errors which have to be made in such operations are eliminated and are reliably excluded. A particular advantage of the device is that the buffer effect is fully available independent from the start of the braking action of the drive element. Even when the movement unit brakes at a given location of the stroke, which, by way of example may be performed in the manner described in DE 85 11 577 U1, the effect which reduces the stress remains fully maintained.

Linear drives are described in EP 0 157 892 B1 and the EP 0 113 790 wherein the drive part and the guide element are movable with respect to each other in a limited manner.

This should merely prevent lateral forces from being transmitted to the drive element and its seals, which can occur during tilt movements of the guide element. However, neither a shock absorbing device is provided, nor is an axial relative movement possible between the decoupled structure elements.

Advantageous further embodiments of the invention are mentioned in the subclaims.

Preferably the buffer device is provided with an elastic means or is formed by one. For example, the elastic means may be a rubber buffer or a spring means. It is also advantageous when the buffer device contains a shock absorbing device or is formed by one, whereby the repercussion after reaching the end position is reduced in an advantageous manner. A combination of elastic means and shock absorbing device would be also advantageous, since it enables a sensible adapation to the given circumstances. In this context it is advantageous when the buffer intensity is selectively adjustable.

A buffer characteristic is particularly advantageous wherein the buffer effect of the buffer device starts at a defined limit load.

In this manner, the movement unit is a rigid structure in the normal case which permits accurate positioning, so that only when reaching a critical load the buffering action occurs. It is generally advantageous for the device if the movement unit, irrespective of the pure axial flexibility, is designed as a rigid structure so that neither rotating nor lateral movements of any type can occur between the guide lement and the drive element. Advantageously adjustment elements are provided which are only used during assembly, so as to perform the relative position between the drive element and the guide element with respect to the housing and the guide conditions.

In a preferred embodiment of the invention the longitudinal slot and the longitudinal guide are provided in circumferential direction in successive housing sides of the housing, so that the segment of the movement unit outside of the housing is formed as a substantially L-shaped body which embraces the housing circumference to a certain extent. This permits, during operation, a lateral mounting of the longitudinal slot which reduces the danger of contamination. Simultaneously, in this case, the guide element is in an upper position which permits a particularly comfortable power acceptance.

The inventive linear drive relates in particular to a so-called slot cylinder, whereby the drive element is a fluidically driven piston and that the longitudinal slot is closed by a sealing tape which prevents the leaking of the pressure medium.

Figure 2:
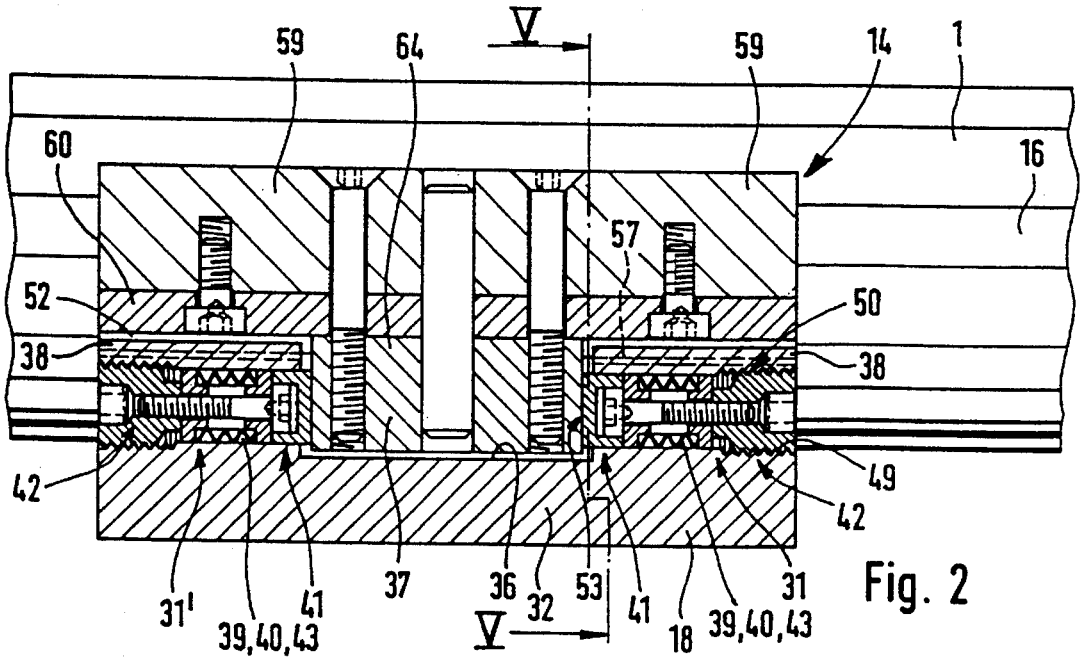
Figure 3:
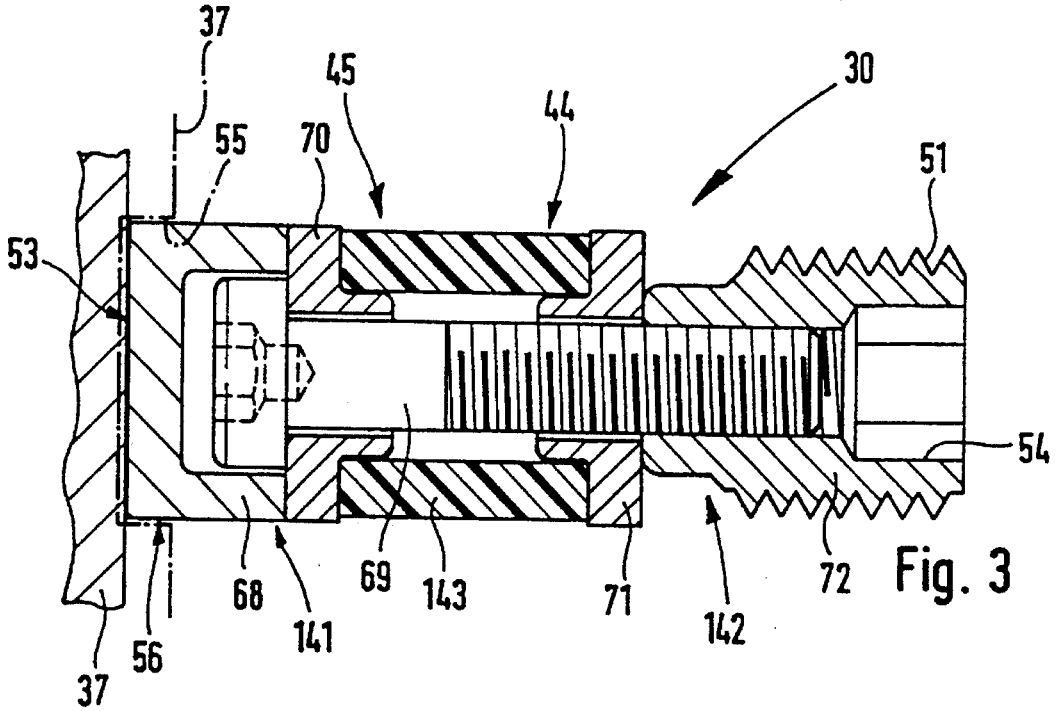
Figure 4:
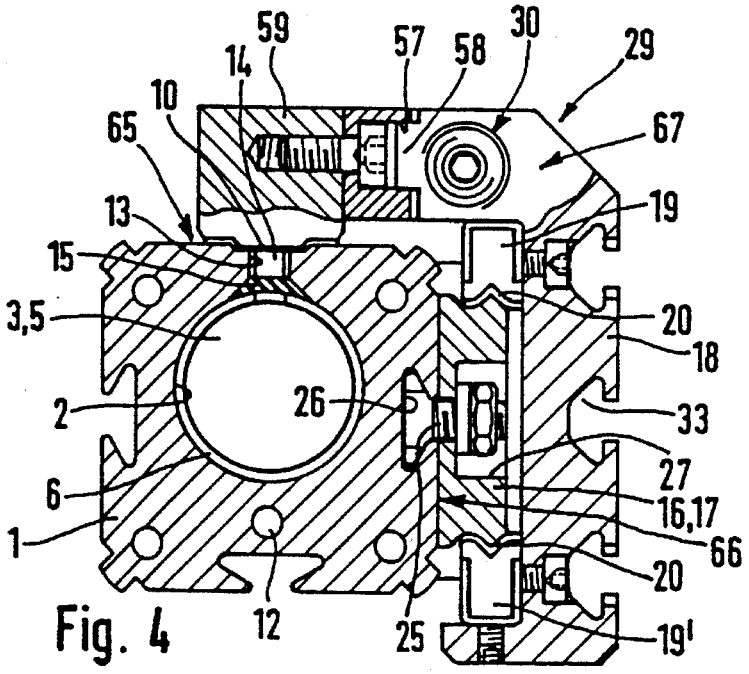
Figure 5:
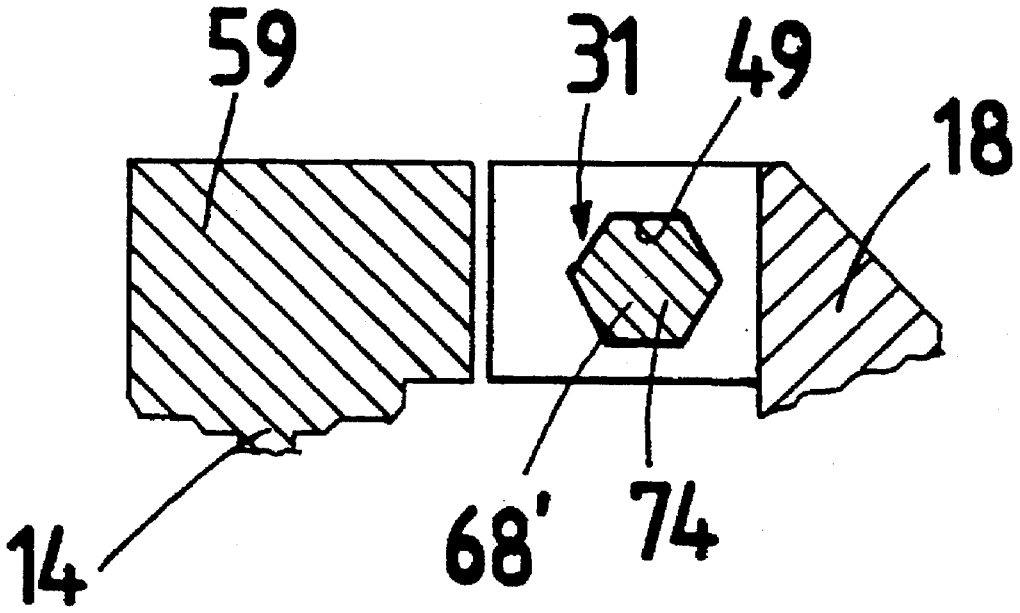

The invention will be explained in more detail in the following in conjunction with the appended drawings which illustrate:

FIG. 1 a first structure of the linear drive in a perspective view,

FIG. 2 a longitudinal section through the movement unit of the linear drive of FIG. 1 in acordance with the cutting line II in a plan view, FIG. 3 the enlarged illustration of a preferred embodiment of a buffer unit of the buffer device in a longitudinal section, FIG. 4 a cross sectional view through the linear drive of FIG. 1 in accordance with a section line IV—IV seen in the longitudinal direction, and FIG. 5 a partially modified embodiment in a partial view of the view in accordance with the intersectional line V—V of FIG. 2.

The linear drive of the exemplified embodiment is a pneumatically driven slot cylinder, with which the measures relating to the buffer device can be realized in linear drives of a different type.

The linear drive is provided with a longitudinally extending housing 1, which in the present case is formed as a cylinder housing. As can be seen from FIG. 4 it has a housing chamber 2 wherein a drive element 3 oscillates in longitudinal direction 4 of the housing. The drive element 3 of the exemplified embodiment is a piston 5 which is circumferentially sealed 6 with respect to the inner wall of housing chamber 2. In this manner, the housing chamber 2 is separated into two operating chambers which are not shown in detail and which can be filled with pressure medium or vented by means of connecting openings 7 provided on the housing. Both connecting openings 7 of the exemplified embodiment are mounted in a common axial housing front face 11, so that the connection to the remote operating chamber is performed preferably through a housing conduit 12 illustrated in FIG. 4.

The housing 1 is provided at one location with a longitudinal slot 13 extending in longitudinal direction 4. It connects the housing chamber 2 with the environment. A lug 14 extends outwardly of this slot which, in the exemplified embodiment, is rigidly connected with the drive element 3. It immediately moves with the drive element 3 which can be picked up from the outside.

A sealing tape 15 covers or closes the longitudinal slot 13 from the housing chamber 2 for a pressure medium sealing of the operating chambers. This sealing tape 15 is advantageously flexible and is fed displaceably through an opening (not shown) in the range of the lug 14, whereby this opening is connected with the drive element 2. In this manner the operating chambers are tightly closed at any position of the drive element 3, without impairing the function of the lug 14. A cover tape 10 indicated in FIG. 1 may be positioned in a corresponding manner on the outside of the longitudinal slot 13 so as to prevent the penetration of impurities. Linear drives of this type as well as their mode of operations are known to the person skilled in the art, for example, from DE 31 24 915 C2 or from EP 0 157 892 B1, so that further explanations are not required here and reference is made to these patents.

The linear drive of the exemplified embodiment is provided with a longitudinal guide 16 which extends in the longitudinal direction 4 and which is mounted on housing 1. Preferably it is formed by a guide rail 17 which is mounted on housing 1. A carrier like guide element 18 is provided which is longitudinally movable on the longitudinal guide 16 and is moved by this in its longitudinal movement. In the exemplified embodiment the guide element 18 is provided with guide elements 19,19' which engage from opposite sides on guide paths 20,20' of guide rail 17, so that a play free support is obtained transversely with the coinciding movement direction 24 in the longitudinal direction 4. Advantageously the desired guide play may be adjusted, if so desired, by guide elements 19,19'. The type of guiding may be a slide guide or a roller guide depending on the type of the guide elements. However, in all cases it is advantageous that the guide rail 17 is claw like and is gripped by the guide element 18 or the guide elements 19 thereof.

In the exemplified embodiment the guide rail 17 itself is fixedly mounted on housing 1 with a plurality of mounting elements 25, whereby the mounting elements 25 are anchored in a longitudinal groove 26 on the housing. In this manner support points are obtained over the length of the guide rail 17 at different locations. Mounting screws, for example, may be used for the mounting elements 25 which are provided with a foot which is anchorable in the longitudinal groove 26.

Due to the fact that a certain movement play is assured before the assembly between the mounting elements 25 and the guide rail 17, the guide rail 17 can be exactly aligned and fixed in the given desired position by tightening the screws 25. The transverse bores 27 of the guide rail 17 which receive the mounting elements are closed by cover caps 28 as can be seen in FIG. 1.

The guide element 18 is connected with lug 14 in such a manner that a movement unit 28 is created together with the drive element 3. When the drive element 3 is displaced in the longitudinal direction 4, then this movement is transmitted through the lug 14 directly to the guide element 18, so that a unitary synchronous movement is provided. The guide element 18 is used for loads. Any given articles or structural elements, in short called loads, can be detachably mounted. For this purpose the exemplified guide element 18 is provided with a plurality of mounting keyseats 33. By actuating the drive element 3 these loads, which are not illustrated in detail, can be linearily transported and can be positioned at various locations, if so desired. So that these procedures run precisely the drive element 3, the lug 14 and the guide element 18 are rigidly connected with each other in the exemplified embodiment, irrespective of the buffer device which will be explained in detail. In view of the accurate guiding of the guide element 18 and the accurate adjusting of the guide rail 17 on housing 1 any eventual transverse, tilting or rotating movements of the guide element 18 are practically not possible and are reduced at least to such a minimum that the seals 6 of the drive element 3 can be compensated without any problems, so that no wear problems occur. The following explained buffer device may also be used in such embodiments wherein given couplings are provided in the movement unit 29 which permit given compensation movements.

The maximum stroke of the movement unit 29 in the exemplified embodiment is defined by reaching the end positions of the drive element 3 or piston 5, respectively. The stroke movement is abruptly stopped when reaching the end positions. In the exemplified embodiment the drive element 3 impacts onto a counter abutment, not shown in detail, which is mounted in the housing chamber 2 and may be connected with two front face housing lids 34.

When braking the drive element 3 the guide element 18 and its eventual mounted load must brake in a very short time. In order that this can be performed without any additional abutments and simultaneously without any damage to the movement unit 29, a buffer device 30 is interposed into the connection between the guide element 18 and the drive element 3 being active in the direction of movement 24, in accordance With the invention. The same prevents, above all, a breaking of lug 14 at its small riblike segment which extends through the longitudinal slot 13. The buffer device successfully prevents the occuring of load peaks, so that even under a high transport load a permanent operation is possible without any danger of destruction or wear.

The buffer device 30 realized in the exemplified embodiment acts exclusively in the longitudinal direction 4 and permits a limited axial movement at a certain load due to the connected drive and guide parts. The energy to be generated substantially reduces the peak loads.

The buffer device 30 of the exemplified embodiment is mounted outside of housing 1 which reduces the structural expense. It also has been shown to be advantageous to mount the buffer device, as illustrated, in the area between the guide element 18 and lug 14.

The buffer device 30 of the exemplified embodiment is provided with two independed acting buffer units 31,31', which are responsible for buffering the movement unit in one of the two possible movement directions. Depending on the movement direction only the one or the other buffer unit becomes active during braking of the drive element 3. The device is particularly shown in FIG. 2. Accordingly, the guide element 18 has a U-shaped edge section 32, whereby a projection 37 of lug 14 immerses into a recess 36. The width of the projection 37 is somewhat smaller than recess 36, so that a slight movement play is provided between the two structural units without buffer units 31,31'. One of the buffer units 31,31' becomes active axially between projection 37 and the flank portions 38 of guide element 18 which limits recess 36, in that it supports itself on projection 37 on the one end and on the associated flank 38 on the other end.

Since the buffer units 31,31' in accordance with FIG. 2 are designed as a direction dependent elastic devices 39, the one which is loaded with pressure becomes active.

The elasticity of the elastic devices are assured preferably by means of spring devices 40, which may be cup spring sets. By selecting the spring arrangement, the desired buffer charcteristic may be set, which in the exemplified emodiment is selected in such a manner that the buffer effect only starts at a certain limit load. Below this load limit the movement unit 29 acts as a complete rigid unit in the axial direction. The advantage is that the highest precision is provided during the transport of a load and that the buffer device actually only operates when the case of load occurs. It also should be noted that the deformation paths assured by the buffer device generally are in the tenth of millimeter range.

The buffer units 31,31' are advantageous that they can be brought into a desired pretension before installation and then be installed into the movement unit 29. For this purpose each buffer unit 31,31' is provided with two tension elements 41,42 which can be adjusted relatively with respect to each other, whereby the acual buffering element 43 is located therebetween.

By adjusting the two tension elements 41,42 the pretension of the buffering element 43 can be set. In the mounted condition illustrated in FIG. 2, the one tension element 41 is supported on the axial front face 37 and the tension element 42 on the associated flank part 38 of the guide element 18.

The buffer units 31,31' may also be designed as shock absorbers 44 as indicated, by way of example, in buffer unit 45 of FIG. 3. The structure basically corresponds to the buffer units 31,31', so that the corresponding structural parts are increased by the reference number "100".

The difference is in the actual buffering part 143, which in this case is designed as a buffering annular element. Alternatively, it would also be possible to use buffering elements wherein the effects of elastic devices and shock absorbers are combined. This could be achieved, for example, by a parallel arrangement of spring and dampening elements, or by using buffering parts which act like springs as well as dampening in view of their material characteristics. A shock absorbing effect is advantageous since it reduces, above all, the intensity of the impact and/or vibrations.

In the exemplified embodiment the buffer units 31,31' also form the adjusting means for facilitating the assembly of the movement unit 29 on housing 1. Before assembly the guide element 18 is separated from lug 14 and is mounted independently on the longitudinal guide 16, whereby the buffer units 31,31' are immersed into the recess 49 of flank parts 38. Advantageously, the recesses 49 are designed as throughput openings extending in longitudial direction 4, which have an inner thread segment 50 with which the one tension element 42,142 engages by means of a complimentary outer thread 51. After the correct association to the lug 14 is made, its projection 37 extends into the recess 36. In the area of the separation location between the lug 14 and the guide element 18 a slot 52 is generally provided which can be of different size depending on the tolerances of the different linear drives. Now, the buffer units 31,31' are prescrewed by the thread engagement 50,51 against projection 37 until the second tension element 41,141 with its front face 53 engages the side face of projection 37. This establishes the axial positioning. The screw action permits, in the exemplified embodiment, a second tool engagement part 54 which is mounted in the outer tension element 41 which permits the engagement of a screw tool, for example, an outer many sided monkey wrench.

In order to achieve the desired transverse stabilisation, the front face 53 is provided with adhesive before placing the projection 37, so that a nondetachable adhesive connection is achieved in the mounted condition.

As an alternative solution the dash dotted line in the figure would also be feasable. Here, the projection 37 has a centering recess 55 into which the tension element 141 immerses into a complimentary center segment 56. In order to receive a complete tensionless assembly, the first mentioned assembly is preferred.

In order to exclude tilting movements between the guide element 18 and the lug 14 a corresponding positive locking connection is provided in the exemplified embodiment in the area of the aforementioned separation location or the provided slot 52. This can be seen particularly well in FIG. 4. Accordingly, the lug 14 is provided with a groove like recess 57 extending in the longitudinal direction 4 facing guide element 18 into which the guide element 18 engages with a complimentary safety projection. In the exemplified embodiment the safety projection as well as the recess 57 are separated into a plurality of longitudinal segments which are located on the flank parts 38 and the parts of lug 14.

Corresponding recess and projection segments may also be provided in the area of front face 37 and the bottom of recess 36.

In the exemplified embodiment the recess 57 as well as the complemetary safety projection 58 have parallel side faces so that a more or less immersion depth is made possible which determines the width of slot 52. This eliminates assembly caused tensions which may occur in other alternative forms, for example, when using dove tail profiles.

As shown in FIG. 2, it is possible that lug 14 may consist of a plurality of parts being connected with each other. A bar 60 is screwed laterally on the lug segment 59 which is located immediately outside of the longitudinal segment 13, whereby the bar is provided with a groove 57. Immediately following is a center longitudinally mounted block like element 64 which forms projection 37. The multi part embodiment permits a selection of material. Less loaded parts may consist of aluminum, while the bar 60 should be of a material with a high hardness.

It is undertood that the arrangement of recess 57 and safety projection 58 can be reversed with respect to the lug 14 and the guide element 18.

Housing 1 of the exemplified linear motor has an outer square cross sectional shape. Thus, the longitudinal slot 13 and the longitudinal guide 16 are provided in sequential housing sides 65,66 in the circumferential direction. In this manner the segment of the movement unit 29 which is outside of housing 1 has a substantially L-shaped cross sectional form. The outer segment of the movement unit 29 embraces housing 1 to a certain extent from longitudinal slot 13, whereby the guide element 18 is positioned on the same side as the longitudinal guide 16. Thereby, the buffer device 30 is mounted in the transition area 67 between the parts of the movement unit 29 which correspond to the L-shanks. The preferred position is such that the buffer device 30 is mounted on or approximately on the plane which contains the two guideways 20. The separation location which determines the slot 52 is preferably located on the housing side 65 which contains the longitudinal slot 13.

The selected embodiment of the movement unit 29 has the advantage that the linear drive may be mounted with the housing side 66 pointing upward during operation, so that the guide element 18 for mounting loads is optimally accessible. At the same time the longitudinal slot is located laterally which makes the penetration of dirt more difficult. Since the longitudinal guide 16 is concentrated on one side of the longitudinal slot 13, the guide play is not impaired by an eventual pressure caused widening of the longitudinal slot 13.

With respect to the buffer units 31,31'45 it should also be mentioned that the front face 53 is advantageously shaped as a plain face and is tipstretched on a potlike element 68 in the exemplified embodiment, which is a component of the multipart second tension element 41,141. A further component of this tension element 41,141 is a screw 69, whose head is covered by the potlike element 68. A plate 70 engages the shank side of the screw head on which the buffer like part 43,143 is supported.

The potlike element 68 is also engaging plate 70 with an edge on the opening side. Also, the other tension element is provided with a plate 71 which is mounted on the screw shaft which is admitted by a nut like screw member 72 which has the outer thread 51 and the tool engagement part 54. The buffering part 43 is arranged preferably coaxially with respect to the screw shaft.

FIG. 5 illustrates a variant which prevents the tilt movements between the guide element 18 and the lug 14 in a particularly simple manner. The selected illustration corresponds to a section in accordance with line V—V of FIG. 2, whereby it is a modified structural design with respect to FIG. 2.

One can see the lug segment 59 and the laterally arranged guide element 18. In contrast to the embodiments of FIGS. 1, 2 and 4 there is no groove like recess 57 and the safety projection 58. Instead, an indirect tilt safety is realized by using the buffer units, one of which is shown, namely (31). It is provided that in the exemplified embodiment a modified potlike element 68' which forms the safety element 74 of the given buffer element buffer unit the lug 14 as well as as the guide element 18 is in rotation connected mounting with respect to the longitudinal axis of the given buffer unit. The rotation mounted connection to the lug 14 may be achieved by adhesive bonding in accordance with the exemplified embodiment of FIG. 2 or, for example, in that the safety element 74 is inserted with a segment of noncircular outer shape, corresponding to FIG. 3, into a complimentary center recess 55 of projection 37. The twist proof connection to lug 14 is designed in such a manner that the buffer effect is not impaired and that an axial movement of the safety element 74 is possible within the associated recess 49. By way of example, the safety element 74 is twist proof and axially displable with a noncircular outer shaped longitudinal segment shaped end section in the recess 49. In the exemplified embodiment the safety element 74 as well as the recess 49 in the coacting area have a multi-corner shape, advantageously a regular hexagonal shape. In this manner a safety against twisting and radial displacement is provided with simple means, without impairing the axial displaceability. Due to the elimination of the groove and tongue connection 57,58 the structure of the linear drive is very much simplified. Advantageously, an intermediate space, illustrated in FIG. 5, remains between the lug 14 and the guide elelement 18.

We claim:

1. A linear drive comprising:

a housing, said housing being provided with a longitudinal slot;

a longitudinally moveable drive element mounted in said housing;

a first longitudinal guide element mounted outside of said housing;

a second guide element which is guided movably in a longitudinal direction on said first guide element and which is adapted to receive a load to be moved;

a lug extending through said longitudinal slot forming a movement unit with said drive element and said second guide element, said movement unit having a longitudinal direction of movement; and a buffer unit effective in said direction of movement of said movement unit, said buffer unit cooperating with said second guide element, said buffer unit being interposed in connection between said drive element and said second guide element subsequent to said lug.

2. Linear drive in accordance with claim 1, wherein said buffer unit is mounted outside of said housing.

3. Linear drive in accordance with claims 1 or 2, wherein said buffer unit is mounted in an area between said second guide element and said lug.

4. Linear drive in accordance with claim 1, wherein said buffer unit is an elastic device.

5. Linear drive in accordance with claim 4, wherein said elastic device contains a spring assembly.

6. Linear drive in accordance with claim 1, wherein said buffer unit is a shock absorbing device.

7. Linear drive in accordance with claim 1, wherein said buffer unit combines the effects of an elastic device and a shock absorbing device.

8. Linear drive in accordance with claim 1, wherein said buffer unit includes at least first and second buffer sub-units, said first sub-unit providing buffering in a first sense of said direction of movement and said second sub-unit providing buffering in a second sense of said direction of movement.

9. Linear drive in accordance with claim 1, wherein said buffer unit has a buffering intensity that is adjustable in a changeable manner.

10. Linear drive in accordance with claim 1, wherein an actual buffer effect of said buffer unit starts only after a defined limit load.

11. Linear drive in accordance with claim 1, wherein said movement unit is formed as a substantially rigid structural unit except for axial flexibility provided by said buffer unit.

12. Linear drive in accordance with claim 11, wherein said movement unit is equipped with adjusting means which enable an adjusting of said second guide element guided on said first longitudinal guide element with respect to said drive element guided in the housing, whereby an adjusted relative position between said second guide element and drive element remains unchanged.

13. Linear drive in accordance with claim 1, wherein:

said housing has an outer rectangular cross section shape;

said longitudinal slot and said first longitudinal guide are provided in adjacent housing sides in a circumferential direction; and said movement unit has a segment which is located outside of said housing, said segment having a substantially L-shaped cross sectional shape.

14. Linear drive in accordance with claim 13, wherein said segment has two L-shanks meeting in a transition area and said buffer unit is mounted in said transition area between said two L-shanks.

15. Linear drive in accordance with claim 1 wherein said first longitudinal guide is formed by a guide rail mounted on the outside of said housing and is embraced by said second guide element on opposite sides.

16. Linear drive in accordance with claim 1 wherein:

said housing is a cylinder housing with a pressure medium tight housing chamber;

said longitudinal slot is sealed by means of a sealing tape;

said drive element is in the form of a piston; and said piston is actuated by said pressure medium.

17. Linear drive in accordance with claim 5, wherein said spring assembly is a cup spring assembly.

* * * * *